United States Patent [19]

Schwarz

[11] 4,059,284

[45] Nov. 22, 1977

[54] SKI BRAKE MECHANISM

[76] Inventor: Günter Schwarz, Steinacherstr. 67, 8804 Au, Switzerland

[21] Appl. No.: 667,689

[22] Filed: Mar. 17, 1976

[30] Foreign Application Priority Data

| | | |
|---|---|---|
| Mar. 21, 1975 | Switzerland | 3847/75 |
| Sept. 9, 1975 | Switzerland | 11759/75 |
| Jan. 7, 1976 | Switzerland | 188/76 |

[51] Int. Cl.[2] ..... A63C 7/10

[52] U.S. Cl. ..... 280/605

[58] Field of Search ..... 280/605, 604, 633, 614, 280/611

[56] References Cited

U.S. PATENT DOCUMENTS

| | | | |
|---|---|---|---|
| 3,884,487 | 5/1975 | Wherli | 280/605 |
| 3,930,659 | 1/1976 | Salomon | 280/605 |
| 3,989,271 | 11/1976 | Riedel | 280/605 |

FOREIGN PATENT DOCUMENTS

| | | | |
|---|---|---|---|
| 2,429,639 | 3/1975 | Germany | 280/605 |

*Primary Examiner*—Joseph F. Peters, Jr.
*Assistant Examiner*—David M. Mitchell
*Attorney, Agent, or Firm*—Werner W. Kleeman

[57] ABSTRACT

A ski brake mechanism comprising at least one laterally positioned brake arm for the ski which can be rocked into a position below the plane of the running surface of the ski and an actuation portion or component which can be depressed by the ski boot. The brake arm and actuation portion are essentially formed as one-piece from a common spring wire. The brake arm essentially consists of a loop-shaped section of the spring wire, the two legs of which are mounted upon the ski by means of two transversely extending mutually spaced pivot shafts or axes. The actuation portion essentially comprises a wire section merging in a lever-like fashion at one of the two legs.

15 Claims, 6 Drawing Figures

SKI BRAKE MECHANISM

BACKGROUND OF THE INVENTION

The present invention relates to a new and improved construction of a brake mechanism for skis, which is of the type comprising at least one brake arm which can be laterally rocked to a position below the plane of the running surface of the ski, a spring portion and an actuation portion which can be depressed or downwardly urged by the ski boot, and which components are formed in one-piece from a common spring wire.

With a state-of-the-art brake mechanism of this type, the spring portion or component consists of a spring bracket extending in the form of one-half of a screw winding or coil transversely across the ski. The spring bracket, as long as it is not depressed by the action of the ski boot against the upper surface of the ski in opposition to its spring force, extends upwardly at an inclination from the ski, whereas the brake arm essentially is formed by a simple wire section which is flexed from the spring bracket and at the same time forms its support or bearing. Such type construction is associated with the drawback that the spring wire must be relatively thick in order to prevent, under the influence of the braking force, an excessive bending of the brake arm, and, therefore, for upwardly rocking the brake arm by depressing the spring bracket, a considerable force is required. Furthermore, the spring bracket requires a certain minimum width and a corresponding amount of space upon the surface of the ski. Finally, the wire bracket extending upwardly at an inclination and nonsymmetrically with regard to the ski has an unpleasing appearance and prevents the possibility of, for instance, combining the relevant brake mechanism with the heel holder of the ski binding or arranging the brake mechanism on both sides of the ski.

SUMMARY OF THE INVENTION

It is a primary object of the present invention to provide an improved construction of ski brake mechanism which is not associated with the aforementioned drawbacks and limitations of the prior art proposals.

Another and more specific object of the present invention contemplates, utilizing a ski brake mechanism of the previously mentioned type which has certain attractive features in respect of its simplicity and advantageous operation and overcoming the previously discussed drawbacks thereof, i.e., especially to insure that the brake arm can bend or deflect only slightly under the action of the braking force notwithstanding the fact that the brake mechanism can be easily brought into its travel position.

In keeping with the foregoing objects, it is a further objective of the invention to devise a ski brake mechanism permitting relatively great freedom in the design of the form of the actuation portion in order, among other things, to also provide new possibilities for the mounting of the brake mechanism.

Now in order to implement these and still further objects of the invention, which will become more readily apparent as the description proceeds, the ski brake mechanism of this development is manifested by the features that the brake arm essentially consists of a loop-shaped section of the spring wire, both legs of which are mounted upon the ski with the aid of two transversely extending mutually spaced pivot shafts or axes. Further, the actuation portion essentially consists of a lever-like wire section merging with one of the legs.

By virtue of this construction, the brake arm, which is reinforced by the loop-shaped wire guide, also forms the spring portion, and the actuation portion can be designed to be extremely slim at least over a considerable portion of its length.

Advantageously, both of the legs of the brake arm are initially slightly curved in order that they can more easily bend or stretch, respectively, upon depression of the actuation portion.

Both of the pivot shafts or axes can be formed by sections of the spring wire extending transversely from both of the legs, whereby the actuation portion merges with the other end of the relevent wire section or, alternately, by stationary journals about which the spring wire is at least partially bent so that the brake arm and actuation portion are essentially located in one plane. The free end of the lever-like actuation portion can be bent or flexed parallel to the pivot axes and can carry a pivotable actuation plate or roller which bears against the underside of the ski boot.

To provide for an independent attachment of the brake mechanism at the ski there can be utilized an appropriate holder plate. On the other hand it is however also possible for the heel portion of the ski binding to have recesses for the reception of the wire sections forming the pivot shafts or axes, or for carrying the journals, whereby there is no need for a special holder plate. A holder plate can be formed for instance of sheet metal bent about the spring wire sections forming the pivot shafts or axes and indented or recessed therebetween in order to fixedly retain the same. One end of the holder plate can be arranged below a part of the ski binding, preferably the heel portion, so that the holder plate and thus the entire brake mechanism can be secured to the ski at least partially by the screws or the like of the ski binding. While this requires an accommodation of the holder plates to the associated ski binding, nonetheless the mounting operation is considerably simplified and facilitated. On the other hand, the holder plates can possess, in the lengthwise direction of the ski, tandem pairs of oppositely inclined rows of holes, in order to be able to mount them without change in conjunction with different ski bindings. With separate holder plates arranged at both sides, the same can then also be used for skis of different widths, without the need for separate drilling templates for the drilling of the screw holes needed for attachment. In addition, the drilling templates provided for the ski binding can also be used for the attachment of the brake mechanism, by selecting the appropriate holes of the holder plate.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
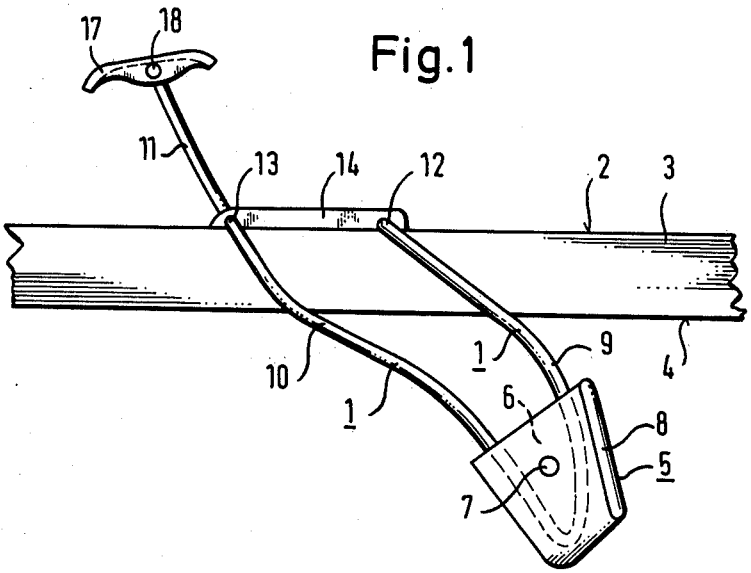
FIG. 1 is a side view of a brake mechanism applied to the ski and constructed according to a first exemplary embodiment of the invention and shown in the ski brake or braking position.

Describing now the drawings, with the embodiment according to FIG. 1 the brake arm 1 which is essentially formed by a loop of a spring wire will be seen to extend laterally from the upper surface 2 of the ski 3 downwardly to a location below the running surface 4 of the ski, so that the brake arm can engage with the snow for the purpose of braking the ski or preventing its sliding away under the action of its own weight.

In order to intensify the braking effort or action there is mounted or applied at the closed end of the wire loop a brake blade or wing 5, for instance formed of plastic. As shown, the blade 5 can have a pocket-like flat recess 6 into which the wire loop of the brake arm 1 piercingly extends. With the aid of a pin 7 or equivalent structure extending transversely through the recess 6, the brake blade or wing 5 is secured positively to the wire loop. Since however the pin 7 is located in spaced relationship from the wire the resilient or spring action of the wire loop is not impaired. An edge or marginal portion 8 of the brake blade 5 extends approximately at right angles to its flat portion having the recess 6 and, therefore, in the brake position, transversely to the direction of travel of the ski.

Figure 2:
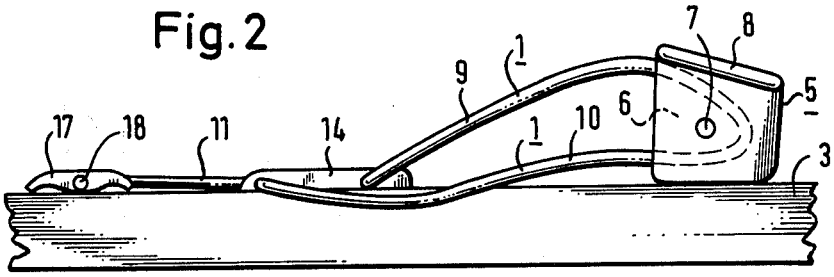
FIG. 2 illustrates the ski brake mechanism of FIG. 1 in the travel or preparatory position.

In order to improve the spring and brake action, both of the legs 9 and 10 of the brake arm 1 are curved slightly in the same direction. This curvature or bending enables the leg 9, when raising the brake arm 1 into the position of FIG. 2 to bend easier whereas the leg 10 can extend or stretch. The upward raising of the brake arm is accomplished by depressing a lever-like actuation portion 11. As is shown in FIG. 2, the brake arm 1 thus comes to lie essentially above the ski.

Both of the pivot axes or pivot shafts of the brake arm are formed by transversely extending spring wire sections 12 and 13 which merge with similarly directed right-angle bends at the legs 9 and 10. Further, the spring wire sections 12 and 13 are rotatably mounted by means of a holder plate 14 upon the ski to permit the aforedescribed pivotal movement of the brake arms. Moreover, to prevent lateral retraction or withdrawal of the wire section 12 out of the holder plate 14 therre is provided a further bend or bent portion 15 (FIG. 3) or a head or enlarged portion 16 (FIG. 4), whereas the actuation portion 11 merges with the pivot shaft 13 through the agency of a further right-angle bend or bent portion.

Figure 3:
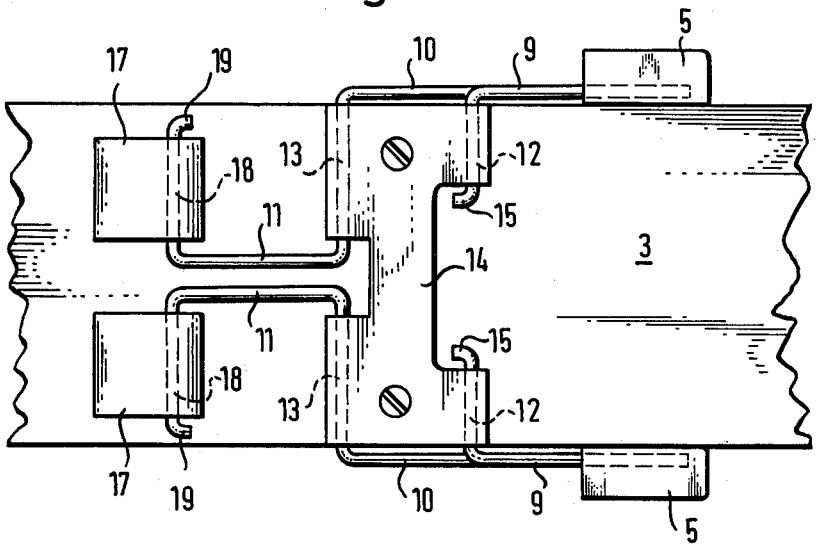
FIG. 3 is a plan view of the brake mechanism of FIG. 1 in a symmetrical arrangement.

In order to still further facilitate the depression of the actuation portion 11 and, in particular, in order to prevent its free end from hooking into the typically profiled sole of the ski boot, the actuation portion 11 advantageously carries at its free end an actuation plate 17 which is pivotable about a transversely extending bent portion 18 of the actuation portion or lever. This actuation plate 17, according to the showing of FIG. 3 is secured in position by a further bent portion 19, or according to the arrangement of FIG. 4 by a head or enlarged portion 20.

If the ski boot is placed upon the actuation plate 17 then such pivots to such an extent until it comes to lie flat beneath the ski boot sole and therefore the sole profile can glide thereon without hinderance, whereas the actuation portion 11 is rocked downwardly by being pushed downwards as occurs when stepping into the ski binding. If the actuation portion is released from the ski boot, then the brake arm 1 suddenly rocks downwardly into the ski brake position of FIG. 1 under the influence of the inherently effective spring tension of such brake arm.

A double-sided construction of brake mechanism is advantageous due to the enhanced braking action. For this purpose there is arranged at each side of the ski a brake arm 1 with its associated components, such as wire sections 12 and 13 and actuation portion 11 and held in place by a holder plate 14. Thus, according to FIG. 3 there can be provided for both sides a common holder plate 14 extending transversely across the ski 3. According to the showing of FIG. 4 there are provided for both brake arms separate plate components 14′and 14″ which however are interconnected by a common base plate 21.

Figure 5:
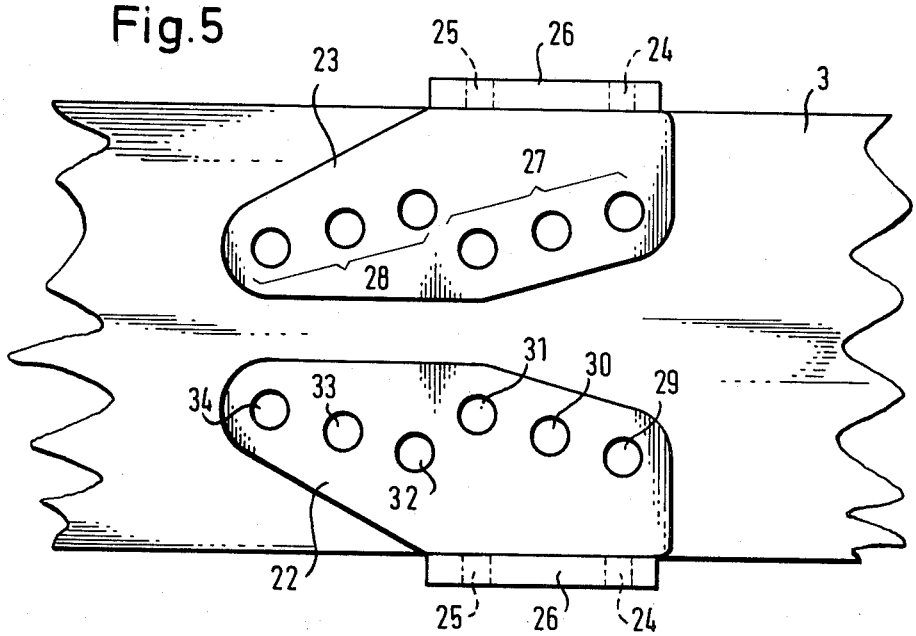
FIG. 5 is a plan view of two separate mirror-symmetrical holder plates having rows of holes inclined with respect to the lengthwise direction of the ski.

With the embodiments of FIG. 5 there are provided two completely separate mirror-symmetric holder plates 22 and 23. In this case the wire sections 12 and 13 of the brake arms arranged at both sides of the ski and forming the pivot shafts or axes are held by bores 24 and 25 of an upwardly bent edge 26 of the associated holder plate. Moreover, each of the holder plates 22 and 23 has two rows 27 and 28 of screw or threaded holes, for instance each row containing three holes as indicated by reference characters 29, 30, 31 and 32, 33, 34 respectively. A screw or the like is introduced through one of the holes 29–31 of the first row of holes 27, this screw simultaneously can constitute the forwardmost attachment screw of the heel holder of the not particularly illustrated ski binding, so that with the same screw there can be retained the ski binding and holder plate which, in this case, can be accordingly located with its rear end beneath the heel portion of the ski binding. Thus, it is unecessary to drill additional holes for one of the two attachment screws of each holder plate. Moreover, the brake mechanism at the same time can be arranged in a more advantageous manner. Also for the drilling of the second screw hole for the holder plate there can be used the drilling templates of the ski binding, which for this purpose need only be shifted in the lengthwise direction of the ski through the spacing corresponding to the holes of both rows of holes.

Figure 4:
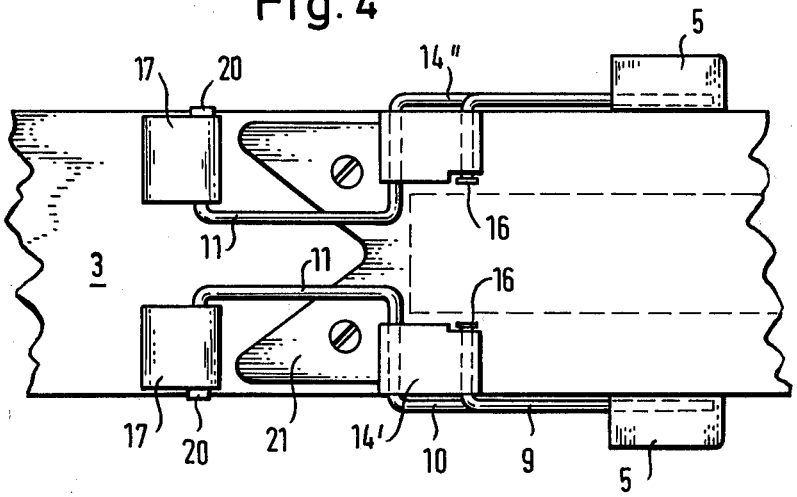
FIG. 4 is a plan view of a likewise double brake mechanism but in a somewhat different embodiment.
Figure 6:
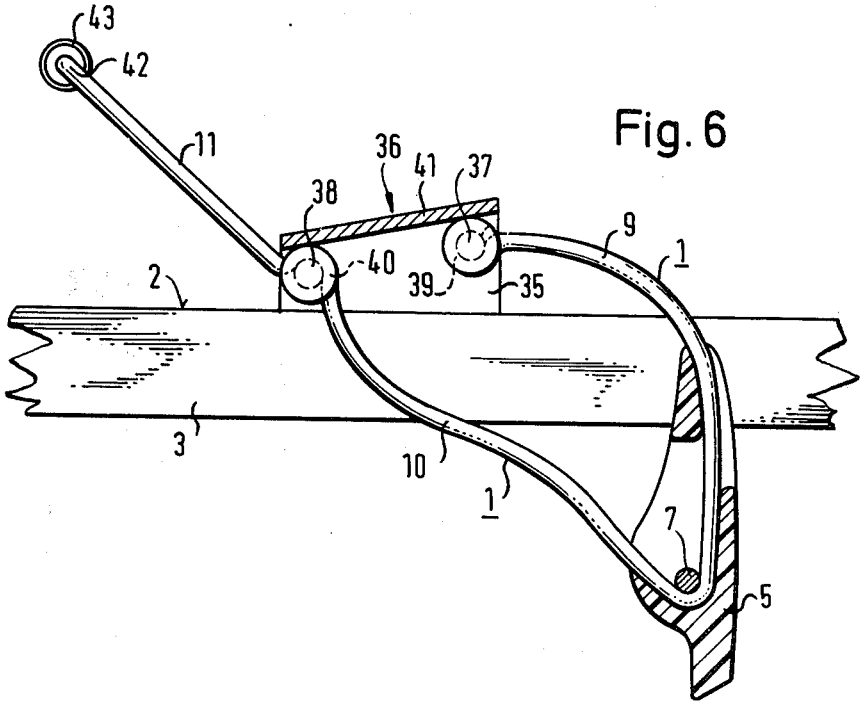
FIG. 6 is a side view, partially in section, of a mounted brake mechanism of a further exemplary embodiment.

The selection of a screw hole in each case from one of both hole rows 27 and 28 is determined by the spacing which both brake arms at opposite sides of the ski should have from one another, that is to say essentially upon the width of the ski while taking into account the lateral spacing possessed by the relevant attachment screws of the binding component. When using the innermost screw holes 31 and 34 there is realized the maximum spacing between both holder plates and vice versa. FIGS. 3, 4 and 5 demonstrate that the components of the inventive brake mechanism, which components are associated with each brake arm, can be constructed to be so small or narrow that the space to both sides of a heel portion of the binding, as such is indicated in FIG. 4, is sufficient to provide at such place the mounting location. This constitutes a considerable advantage of the inventive brake mechanism, which is realized by virtue of the fact that the pivot shafts or axes need only be of such length that there is realized a positive guiding of the brake arm and taking-up of the forces acting thereon. The pivot shafts need not necessarily be formed by transversely extending sections of the spring wire. Thus as shown with the embodiment of FIG. 6 stationary pivot pins or journals 37 and 38 can be provided at an upwardly directed bent portion 35 of a holder plate 36 or at another part connected with the ski, such as for instance the heel portion of the ski binding. These journals 37 and 38 are at least partially surrounded or enclosed by bent portions, i.e., bent-in and bent-out portions 39 and 40, respectively, of the spring wire. In the illustrated embodiment the pivot pin or journal 37 is completely enclosed by the bent portion 39 at the end of the spring wire, whereas the bent portion 40 at the leg 10 surrounds the journal or pivot pin 38 only through an angle which is less than 180°. In order to prevent that the bent portion 40 will disengage the journal 39 a stop 41 is provided in the form of a further bent or flexed portion of the holder plate 36. Since with this embodiment of the ski brake mechanism the actuation portion 11 with the brake arm 1 essentially lies in one plane laterally adjacent the ski, little space is required at the top or upper surface of the ski for the mounting of the brake mechanism, so that such can be mounted particularly easily, for instance at or adjacent an automatic heel step-in safety ski binding. Only the section 42 of the acutation portion 11 which is provided for engaging below the sole of the ski boot extends transversely across the upper surface of the ski. In this embodiment the section 42 is provided with a roll or roller 43. As seen by referring to FIG. 6 there is illustrated a somewhat different construction of the brake blade or wing 5 which in this case is pivotable about the pin 7 or the like through a limited angle.

While there are shown and described present preferred embodiments of the invention, it is to be distinctly understood that the invention is not limited thereto, but may be otherwise variously embodied and practiced within the scope of the following claims.

Accordingly, what is claimed is:

1. A ski brake mechanism for use with a ski having a running surface, comprising a brake arm and an actuation portion which can be depressed by the ski boot, the brake arm and actuation portion being formed integrally from a common spring wire, the brake arm comprising essentially a substantially loop-shaped section of the spring wire providing two legs, means defining two transversely extending mutually spaced pivot shafts and means mounting said means defining the pivot shafts upon the ski, said two legs being connected with said means defining the pivot shafts, said actuation portion essentially comprising a lever-like wire section operatively connected with one of said legs.

2. The brake mechanism as defined in claim 1, wherein both legs are curved.

3. The brake mechanism as defined in claim 2, wherein both legs are curved in the same direction.

4. The brake mechanism as defined in claim 1, wherein said pivot shafts comprise transversely extending spring wire sections extending from both of the legs, the actuation portion merging with an end of its associated spring wire section.

5. The brake mechanism as defined in claim 4, wherein said mounting means includes a holder plate for mounting the brake arm upon the ski, said holder plate having recess means, the spring wire sections forming the pivot shafts being received in the recess means of the holder plate.

6. The brake mechanism as defined in claim 1, wherein said pivot shafts comprise stationary journals, said spring wire having bent portions at least partially surrounding said stationary journals.

7. The brake mechanism as defined in claim 1, wherein said mounting means comprises a holder plate said shafts comprising stationary jounrals mounted to said holder plate.

8. The brake mechanism as defined in claim 6, including stop means cooperating with said bent portions for preventing disengagement of said bent portions from said journals.

9. The brake mechanism as defined in claim 8, wherein said mounting means includes a holder plate having bent ends, said bent ends defining said stop means.

10. The brake mechanism as defined in claim 6, wherein said mounting means includes at least one holder plate for mounting the brake arm in the lengthwise direction of the ski, each said holder plate having a tandem pair of oppositely inclined rows of threaded holes.

11. The brake mechanism as defined in claim 1, including a pivotal actuation plate mounted on said actuation portion.

12. The brake mechanism as defined in claim 11, wherein said actuation portion includes a transversely extending portion, said actuation plate being mounted on said transversely extending portion.

13. The brake mechanism as defined in claim 1, wherein the actuation portion has a free end and including a roller supported on said actuation portion adjacent said free end.

14. The brake mechanism as defined in claim 13, wherein said actuation portion includes a transversely extending portion said roller being supported on said transversely extending portion.

15. A ski brake mechanism for use with a ski having a running surface, comprising a brake arm and an actuation portion connected therewith which can be depressed by the ski boot, the brake arm and actuation portion being formed from spring wire, the brake arm comprising a substantially loop-shaped section of the spring wire forming two legs, means pivotally mounting said two legs at longitudinally spaced positions upon the ski whereby said loop-shaped section is deformed as said legs pivot, said actuation portion comprising a lever-like portion operatively connected with one of said legs.

* * * * *